US005308262A

United States Patent [19]

Chishima

[11] Patent Number: 5,308,262

[45] Date of Patent: May 3, 1994

[54] ELECTRIC CONNECTOR FOR FLEXIBLE RIBBON CABLE

[75] Inventor: Masamitsu Chishima, Yokkaichi, Japan

[73] Assignee: Sumitomo Wiring Systems, Ltd., Yokkaichi, Japan

[21] Appl. No.: 986,964

[22] Filed: Dec. 8, 1992

[30] Foreign Application Priority Data

Dec. 10, 1991 [JP] Japan ..... 3-101517[U]
Dec. 10, 1991 [JP] Japan ..... 3-101520[U]

[51] Int. Cl.[5] ..... H01R 13/00
[52] U.S. Cl. ..... 439/495
[58] Field of Search ..... 439/492–499

[56] References Cited

U.S. PATENT DOCUMENTS 4,519,133 5/1985 Pansanel ..... 439/495
4,734,053 3/1988 Imai ..... 439/495

FOREIGN PATENT DOCUMENTS 60-188488 12/1985 Japan .
64-009377 1/1989 Japan .
3-8886 1/1991 Japan .

*Primary Examiner*—Joseph H. McGlynn

*Attorney, Agent, or Firm*—Sandler Greenblum & Bernstein

[57] ABSTRACT

A connector for a flat cable having a plurality of cable lines laid on a common plane in side-by-side fashion with each other, which comprises a housing having a hollow defined therein and opening outwardly at a front face. Top and bottom walls are formed with respective pluralities of first and second guide grooves both defined therein in communication with the hollow, and terminal members of generally h-shaped configuration equal in number to the number of any one of the first and second guide grooves and arranged in side-by-side fashion in a direction parallel to the longitudinal axis of the housing. Each of the terminal members includes a contact finger having a contact protuberance formed integrally therewith, an anchoring finger extending generally parallel to the contact finger and connected at one end with one end of the contact finger remote from the contact protuberance, and a connecting finger. Each terminal member is accommodated within the housing with the contact and anchoring fingers firmly received within the respective first and second guide grooves while the contact protuberance protruding into the hollow. A lock-on insert is inserted into the hollow to allow the cable lines to be held in contact with the associated contact protuberances, after the flat cable has been inserted into the hollow.

2 Claims, 4 Drawing Sheets

ELECTRIC CONNECTOR FOR FLEXIBLE RIBBON CABLE

BACKGROUND OF THE INVENTION

1. Field of the Invention

The present invention generally relates to an electric connector for electrically connecting a flexible ribbon cable, or a so-called flat cable, having a plurality of bundled parallel cable lines, with a corresponding number of terminal elements in a generally plug-in fashion.

2. Description of the Prior Art

A flexible ribbon cable is known having a plurality of electric lead lines laid parallel to each other and bundled together into a generally ribbon-like configuration. Recent years have seen an increasing use of the ribbon cables in electric apparatuses and appliances. For end-to-end connection between one ribbon cable and the other ribbon cable, or for end-to-terminal connection between a ribbon cable and a terminal structure having a corresponding number of terminal elements, a generally flat connector is employed, having a row of juxtaposed contact elements with which cable lines of the ribbon cable are electrically connected by insertion of the ribbon cable into the connector. With the cable lines inserted into the connector so as to engage the corresponding contact elements, the ribbon cable is locked in position relative to the connector by means of a lock-on insert.

Some of the prior art connectors of the type referred to above will now be discussed in detail with particular reference to FIGS. 9 to 11, respectively.

Referring first to FIG. 9 showing the prior art ribbon cable connector in a partially sectioned, schematic perspective representation, the ribbon cable connector shown therein is disclosed in the Japanese Laid-open Utility Model Application No. 3-8886 published Jan. 28, 1991. This prior art connector comprises a plastic molded housing 1 of a generally rectangular configuration having top and bottom walls and a pair of side walls and also having a generally rectangular sectioned hollow 1*b* defined therein so as to extend across the depth of the housing 1 as measured in a direction parallel to the direction X of insertion of the ribbon cable (not shown). This hollow 1*b* is delimited by top and bottom interior surfaces and a pair of side surfaces. The top wall of the housing 1 has a plurality of juxtaposed terminal members 4 in side-by-side and equally spaced fashion in a direction widthwise of the housing 1.

Each of the terminal members 4 is of a configuration generally similar to the shape of a figure "4" including a contact finger 4*a* and an anchoring finger 4*b*, a bridge 4*d* connecting the contact and anchoring fingers 4*a* and 4*b* together and a connecting finger 4*c* extending outwardly in a direction counter to and in alignment with the contact finger 4*b*. The contact finger 4*a* is bent relative to the bridge 4*d* so as to approach the anchoring finger 4*b*. A free end of the anchoring finger 4*b* is so shaped as to represent a hook.

The top wall of the housing 1 has, for each terminal member 4, a slit 3 defined therein so as to extend from the rear and inwardly of the top wall 1*a* in a direction parallel to the direction of insertion X leaving a partition wall as indicated by 1*a* between it and the hollow 1*b* for receiving the anchoring finger 4*b* of the associated terminal member 4. On the other hand, the bottom wall of the housing 1 is formed with grooves 2 equal in number to the number of the terminal members 4, each of said grooves 2 opening into the hollow 1*b* so that, when the terminal members 4 are press-fitted into the housing 1 with the contact and anchoring fingers 4*a* and 4*b* guided along and into the grooves 2 and the slits 3, respectively, contact protuberances integral with the respective contact fingers 4*a* are exposed into the hollow 1*b* while protruding therein.

A flexible ribbon cable (not shown) is forcibly inserted into the hollow 1*b* to allow cable lines forming the flexible ribbon cable to be electrically connected with the respective contact protuberances of the contact fingers 4*a* and is then retained in a position trapped within the hollow 1*b*.

The prior art connector of the above described construction is generally considered as having a relatively small thickness T, for example, 2.5 mm, but the necessity of the slots 3 for the anchoring fingers 4*b* in addition to the grooves 2 for the contact fingers 4*a*, makes it difficult to manufacture a molding die used to make the housing 1. Even if it is possible to form slender molding pins necessary to form the anchoring slots 3, some of the slender molding pins may be bent or broken under the influence of a pressure of molten plastic during the molding. Therefore, the prior art connector has a problem in that not only is it difficult to form the anchoring slots 3 in the housing precisely, but the productivity tends to be adversely affected.

In addition, the presence of the partition wall 1*a* necessarily increases the spacing S between the contact fingers 4*a* and the anchoring fingers 4*b* and, hence, the thickness T, resulting in an increased size of the connector as a whole.

The Japanese Laid-open Utility Model Publication No. 60-188488 published Dec. 13, 1985, discloses another prior art connector for a flexible ribbon cable as shown in FIG. 10. The connector shown therein comprises a housing 1 having a terminal chamber 1*c* defined therein so as to open in one direction conforming to the direction of insertion X, and a plurality of juxtaposed resilient terminal members 4, one for each terminal chamber 1*c*. Each terminal member 4 is generally of a shape similar to the shape of a figure "S" and is so shaped and so configured as to have a generally U-shaped contact finger 4*e* having a gap 4*f* defined therein for receiving the flexible ribbon cable C and a lead-out finger, said contact finger 4*e* and said lead-out finger 4*g* being continuous to each other so as to depict the shape of a figure "S".

The connector shown in FIG. 10 also comprises a lock-on insert 5 of generally T-shaped cross-section including a generally rectangular closure 5*a* having a slit 5*b* defined therein in a direction parallel to a row of the terminal members 4, and a wedge-like member 5*c* perpendicular to the closure 5*a* and adapted to be inserted into the terminal chamber 1*c*. The slit 5*b* in the closure 5*a* of the lock-on insert 5 is adapted to pass the flexible ribbon cable S therethrough into the terminal chamber 1*c*.

To connect the cable lines electrically with the associated terminal members 4, particularly the contact fingers 4*e*, the lock-on insert 5 is mounted in the housing 1 with the wedge-like member 5*c* inserted generally halfway into the terminal chamber 1*c* as shown in FIG. 10 and, at this time, the lock-on insert 5 is retained in position by a resilient force exerted by the lead-out finger 4*g* and urging the wedge-like member 5*c* against the bottom wall of the housing 1. The flexible ribbon cable C is subsequently inserted through the slit 5b in the lock-on insert 5 and then into the terminal chamber 1c so as to be received within the gap 4f in the contact finger 4e. Thereafter, the lock-on insert 5a is completely inserted to allow the resilient force exerted by the contact and lead-out fingers 4e and 4g to be centered on the contact finger 4e to clamp the flexible ribbon cable C firmly.

According to the prior art connector shown in FIG. 10, since the slit 5b for the passage of the flexible ribbon cable C therethrough is very narrow, making it difficult to insert the flexible ribbon cable C therethrough into the terminal chamber 1c.

To avoid the difficulty encountered with the prior art connector shown in FIG. 10, the Japanese Laid-open Utility Model Publication No. 64-9377 published Jan. 19, 1989, suggests another connector which comprises a loose mounting of the lock-on insert on the housing as shown in FIG. 11 to broaden the mouth through which the flat cable C is inserted. Referring now to FIG. 1, the lock-on insert 5 is hingedly coupled with the housing 1 at a front end thereof when the lock-on insert 5 is in an inoperative position as shown therein, but can be slid towards the completely inserted position when, after the flat cable C has been inserted into the hollow 1b, the lock-on insert 5 is pushed.

However, with the connector of the type disclosed in FIG. 11, it may often occur that, depending on the environment in which the connector is used, no space may be available for accommodating the pivotal movement of the lock-on insert.

SUMMARY OF THE INVENTION

Accordingly, the present invention has been devised with a view to substantially eliminating the above discussed problems and inconveniences inherent in the prior art connector for the flat or flexible ribbon cable and is intended to provide an improved connector which is compact in size and suited for a mass-production at a reduced manufacturing cost.

In order to accomplish the above discussed object, the present invention provides a connector for a flat cable having a plurality of cable lines laid on a common plane in side-by-side fashion with each other, which comprises a housing having a hollow defined therein and opening outwardly at a front face. Top and bottom walls are formed with respective pluralities of first and second guide grooves both defined therein in communication with the hollow, and terminal members of generally h-shaped configuration equal in number to the number of any one of the first and second guide grooves and arranged in side-by-side fashion in a direction parallel to the longitudinal axis of the housing.

Each of the terminal members includes a contact finger having a contact protuberance formed integrally therewith, an anchoring finger extending generally parallel to the contact finger and connected at one end with one end of the contact finger remote from the contact protuberance, and a connecting finger. Each terminal member is accommodated within the housing with the contact and anchoring fingers firmly received within the respective first and second guide grooves while the contact protuberance protruding into the hollow.

A lock-on insert is inserted into the hollow to allow the cable lines to be held in contact with the associated contact protuberances, after the flat cable has been inserted into the hollow.

Preferably, the connector may further comprises means for holding the lock-on insert means at a temporarily mounted position to facilitate an easy insertion of the flat cable into the hollow. In this case, the lock-on insert means includes a generally wedge-like plate member adapted to be engaged into the hollow, said wedge-like plate member having a sloped side edge which defined an insertion passage of an increased size in cooperation with a sloped face of the top wall when the lock-on insert means is held at the temporarily mounted position.

The lock-on insert means may also include a pair of arms lying generally perpendicular to the wedge-like plate member. Each of the arms has a guide recess defined therein and extending in a direction conforming to the direction of insertion of the flat cable into the hollow and wherein said housing has a pair of side guide grooves for receiving the arms with the wedge-like plate member inserted into the hollow. The holding means in this instance comprises a pair of first detent projections protruding laterally outwardly from opposite side walls of the housing, said guide recesses in said arms receiving therein the first detent projection thereby to prevent the lock-on insert means from being separated from the housing.

According to the present invention, no partition wall is employed between any one of the top and bottom walls of the housing and the hollow defined within the housing, but only the guide grooves each opening into the hollow are employed for receiving the contact and anchoring fingers of the associated terminal members. Therefore, it is clear that the housing as a whole can easily be manufactured compact in size and simple in structure by the use of any known plastic molding technique with no need to employ any complicated molding die.

The use of the holding means for temporarily holding the lock-on insert on the housing advantageously avoids a separation of the lock-on insert from the housing during transportation thereof before the connector of the present invention is actually used by a user.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENT

Figure 1:
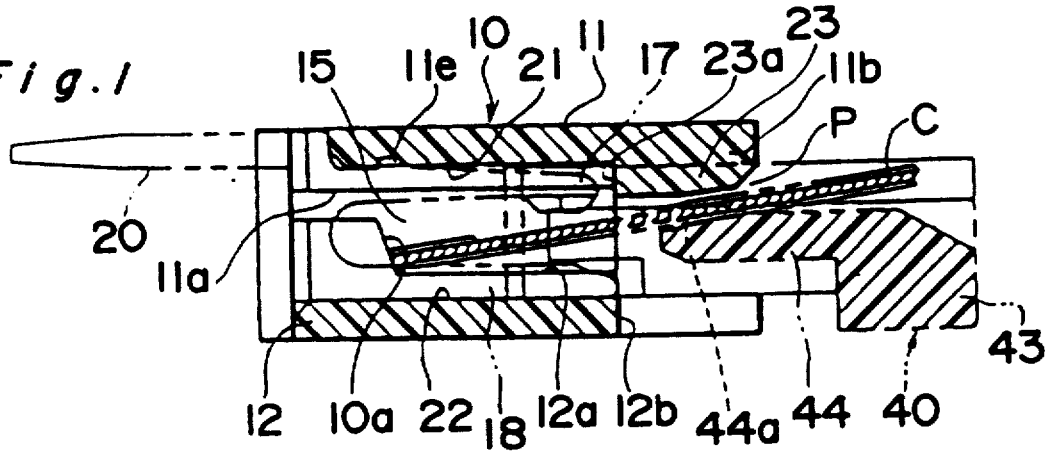
FIGS. 1 and 2 are schematic side sectional views of a connector embodying the present invention, showing the connector in different operative positions, respectively.

Referring to the accompanying drawings and with particular reference to FIGS. 1 to 6, a connector shown therein comprises a plastic molded housing 10 of a generally rectangular configuration made of a synthetic resin having an electrically insulating property. The housing 10 includes top and bottom walls 11 and 12 of rectangular shape, a pair of side walls 13 and 14 and a rear wall assembled together to define a rectangular hollow 15 opening in a direction counter to the rear wall. It is to be noted that the top wall 11 is over-sized relative to the bottom wall 12 so as to define a pent roof 11*b* protruding therefrom in a direction in which the rectangular hollow 15 opens.

In the following description of the preferred embodiment of the present invention, relative terms "front" and "rear" used herein are to be understood as taken in relation to the direction of insertion, shown by the arrow X, of a lock-on insert or a ribbon cable to the connector. On these premises, terms "width", "thickness" and "depth" of the housing 10 are to be understood as representing the dimensions as viewed in a direction parallel to the direction of insertion X.

The housing 10 also has a plurality of juxtaposed and equally spaced slit-like passageways defined within the rectangular hollow 15 in a manner as will be described later and juxtaposed in a direction widthwise of the housing 10 and perpendicular to the direction of insertion of a lock-on insert 40 shown by the arrow X, the function of said lock-on insert 40 being described later. Each passageway extends completely across the depth of the housing 10 and is adapted to accommodate therein a corresponding terminal member 16 in a manner which will be described later.

Figure 3:
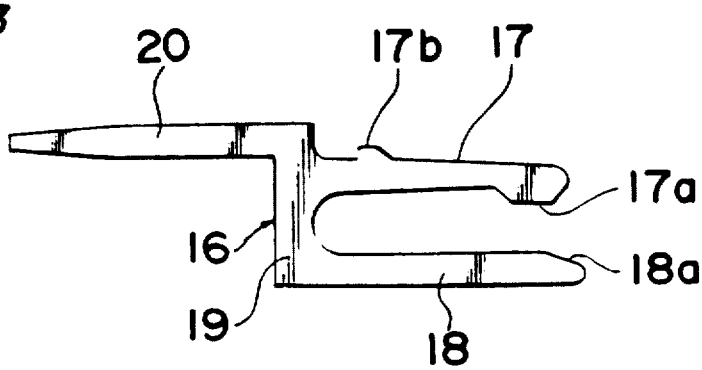
FIG. 3 is a side elevational view of a terminal member employed in the connector.

As best shown in FIG. 3, each terminal member 16 is of a shape generally similar to the shape of a figure "h", having been formed by blanking a metal plate by the use of any known press operation. Each terminal member 16 includes a contact finger 17, an anchoring finger 18 positioned in side-by-side fashion with the contact finger 17, a bridge 19 connecting the contact and anchoring fingers 17 and 18 together, and a connecting finger 20 extending from one end of the bridge 19 adjacent the contact finger 17 in a direction counter to any one of the contact and anchoring fingers 17 and 18. The contact finger 17 having its one end integral with the bridge 19 is preferably bent slightly so as to converge towards the anchoring finger 18 and has its opposite free end integrally formed with a contact protuberance 17*a* protruding towards the anchoring finger 18 and also with an anchoring protuberance 17*b* protruding in a direction away from the anchoring finger 18. It is to be noted that the tip of said contact protuberance 17*a* is made flat in order to secure an increased surface area of contact thereof with a corresponding line forming the flat cable.

By the reason which will become clear from the subsequent description, a free end of the anchoring finger 18 has an edge confronting the contact protuberance 17*a*, which is sloped downwardly at 18*a* as viewed in FIG. 3. Similarly, the connecting finger 20 has its opposite side edges inclined so as to converge towards each other to facilitate insertion thereof into a socket (not shown), mounted on a substrate or a printed circuit board, with which it is electrically connected.

Figure 2:
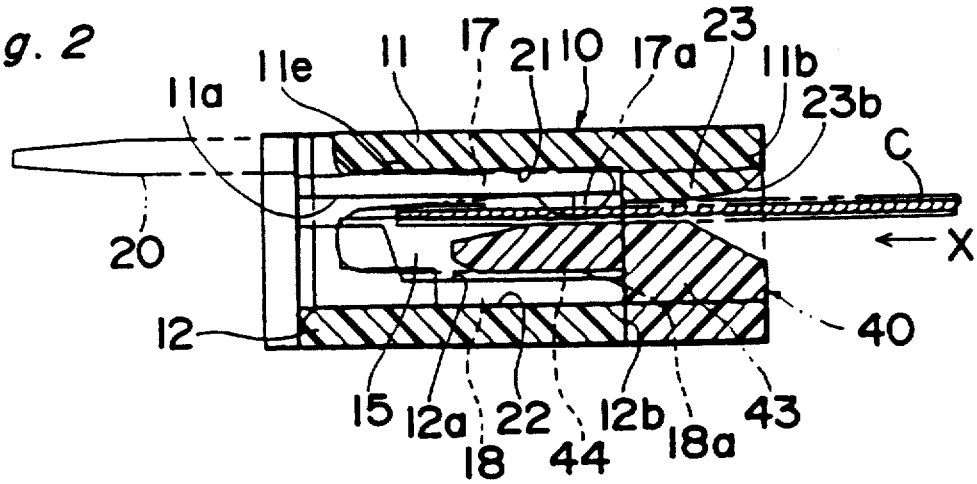
Figure 4:
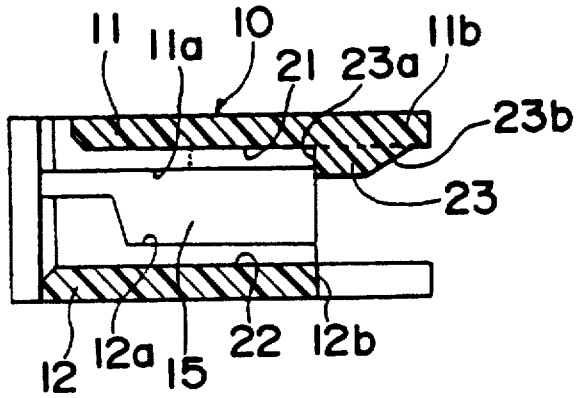
FIG. 4 is a schematic side sectional view of a housing forming a part of the connector.

Referring to FIGS. 1, 2 and 4, an interior surface 11*a* of the top wall 11 of the housing 10 is formed with a plurality of guide grooves 21 extending completely across the depth of the top wall 11 while an interior surface 12*a* of the bottom wall 12 is similarly formed with guide grooves 22 equal in number to the guide grooves 21 and extending completely across the depth of the bottom wall 12 and immediately below the associated guide grooves 21 in the top wall 11. Each passageway referred to above and designed to accommodate the associated terminal member 16 is delimited within the rectangular hollow 15 by one of the guide grooves 21 and the mated guide groove 22 which is located immediately beneath such one of the guide grooves 21.

To hold the terminal member 16 in position within the associated passageway, when the terminal member 16 is inserted thereinto from the rear in a direction counter to the direction of insertion X with the contact and anchoring fingers 17 and 18 guided in the guide grooves 21 and 22, respectively, the pent roof 11*b* integral with the top wall 11 of the housing 10 is integrally formed with a generally elongated guide block 23 so as to protrude downwardly therefrom. This guide block 23 has a stop face 23*a* confronting the guide grooves 21. Therefore, when each terminal member 16 is inserted into the associated passageway having been guided in the paired guide grooves 21 and 22, the free end of the contact finger 17 is brought into engagement with the stop face 23*a*. Also, for facilitating insertion of the flat cable, indicated by C in FIGS. 1 and 2, into the rectangular hollow 15, the guide block 23 has a sloped face 23*b* inclined downwardly towards the rectangular hollow 15 or upwardly towards the outside of the housing 10.

As will become clear from the subsequent description, a side face of the bottom wall 12, indicated by 12*b* in FIGS. 1 and 4 and positioned immediately beneath the guide block 23, serves as a stop with which the lock-on insert 40 is engaged when the lock-on insert 40 is inserted into the rectangular hollow 15 together with the flat cable C.

The housing 10 has a pair of retainer recesses 24 and 25 of generally U-shaped cross-section each delimited by a corresponding side wall of the housing, a top wall extension 11*c* or 11*d* and a bottom wall extension 12*c* or 12*d* and extending completely across the depth of the housing 10. The retainer recesses 24 and 25 are used to receive therein corresponding arms 41 and 42 of the lock-on insert 40 which will be described in detail later.

Figure 5:
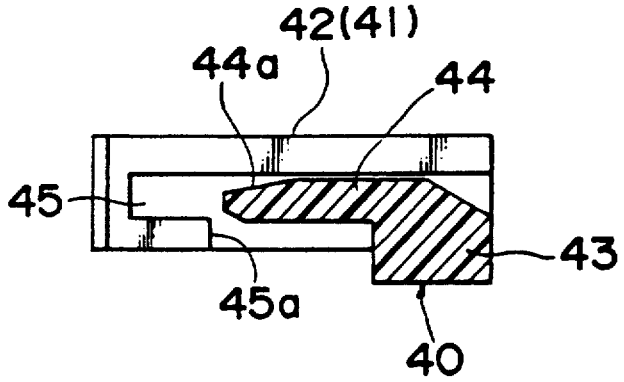
FIG. 5 is a schematic side sectional view of a lock-on insert also forming another part of the connector.
Figure 6:
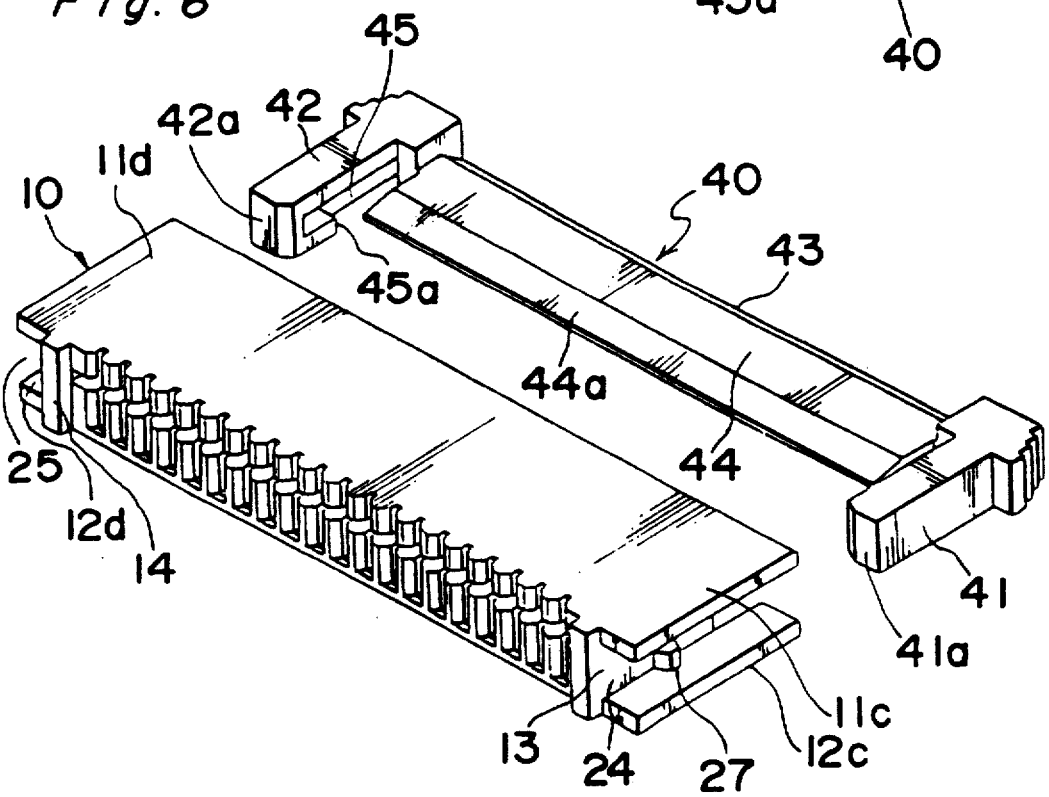
FIG. 6 is a perspective view of the connector with the lock-on insert held in a position separated from the connector housing.

As best shown in FIGS. 5 and 6, the lock-on insert 40 comprises, in addition to the arms 41 and 42, an elongated body 43 of a length substantially equal to the width of the rectangular hollow 15 and of a generally rectangular cross-sectional shape, said arms 41 and 42 being integrated with opposite ends of the elongated body 43 so as to represent a generally U-shaped configuration. Each of the arms 41 and 42 is elastically bendable relative to the elongated body 43 for the purpose which will become clear from the subsequent description. The elongated body 43 is integrally formed with a wedge-like plate 44 extending over the length of the elongated body 43 and protruding laterally outwardly therefrom in a direction conforming to the direction in which the arms 41 and 42 protrude. The wedge-like plate 44 has one of opposite side edges integral with the elongated body 43, the other of the side edges thereof being inclined outwardly downwardly at 44*a* to conform to the inclination of the sloped face 23b of the guide block 23 integral with the pent roof 11b.

The lock-on insert 40 is adapted to be mounted on the housing 10 with the wedge-like plate 44 inserted into the rectangular hollow 15 to retain the flat cable C in position inside the housing 15 as best shown in FIG. 2. Specifically, assuming that the flat cable C has been inserted into the rectangular hollow 15 with cable lines aligned with the associated passageways, the lock-on insert 40 may then be mounted on the housing 10 with the wedge-like plate 44 inserted into the rectangular hollow 15 and with the arms 41 and 42 received within the retainer recesses 24 and 25. In such case, as the wedge-like plate 44 of the lock-on insert 40 is inserted into the hollow 15, a front portion of the flat cable C within the hollow 15 is urged towards the contact fingers 17 of the associated terminal members 16 while having been substantially sandwiched between the interior surface 11a of the top wall 11 and the wedge-like plate 44 and, at the time the wedge-like plate 44 is completely inserted as best shown in FIG. 2, the respective cable lines of the flat cable are brought into electrical contact with the contact protuberances 17a of the contact fingers 17.

While the connector of the above described construction functions satisfactory, the lock-on insert 40 is so designed as to be temporarily mounted on the housing 10 to avoid the necessity of transporting the housing 10 and the lock-on insert 40 separately. If the housing 10 having the terminal members 16 installed therein and the associated lock-on insert 40 are separate from each other and are transported separately, one of them will be left inoperative unless the other of them is readily available. To avoid this possibility, the lock-on insert 40 forming a part of the connector according to the present invention is so designed as to be retained at a temporarily inserted position and as to be moved to a completely inserted position after the flat cable C has been inserted into the hollow 15 within the housing 10, in a manner which will now be described with particular reference to FIGS. 5 to 8.

Figure 7:
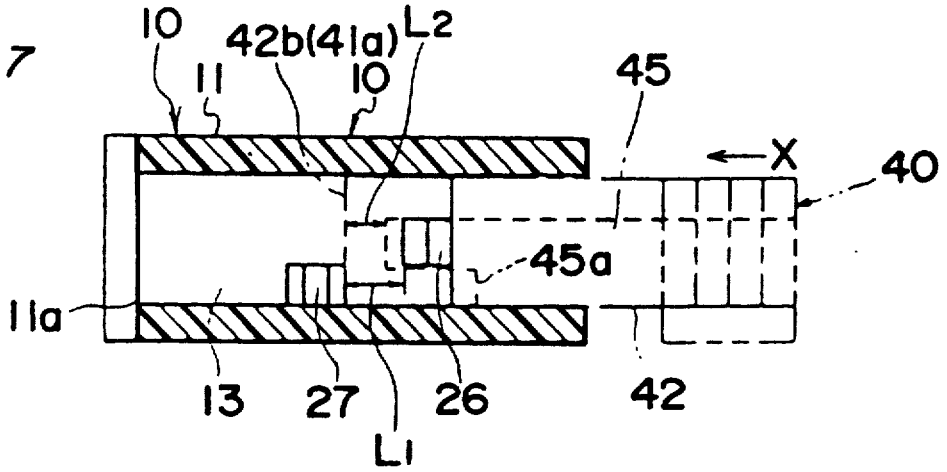
FIGS. 7 and 8 are schematic side sectional views of the connector showing the lock-on insert held at different operative positions, respectively.
Figure 8:
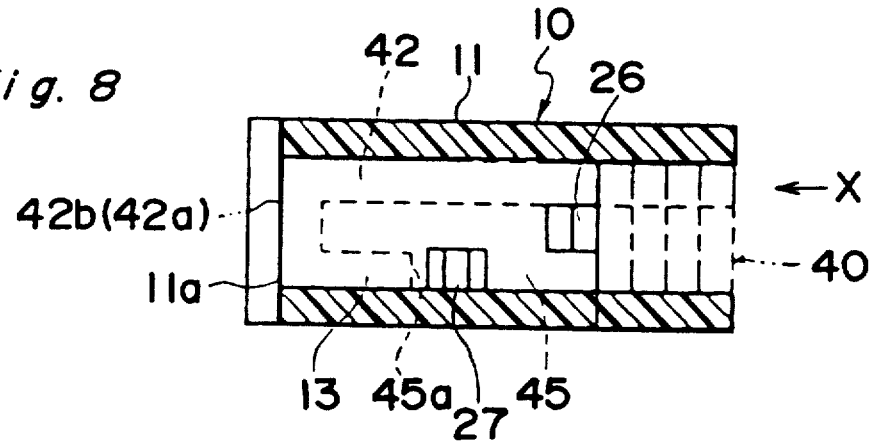
Figure 9:
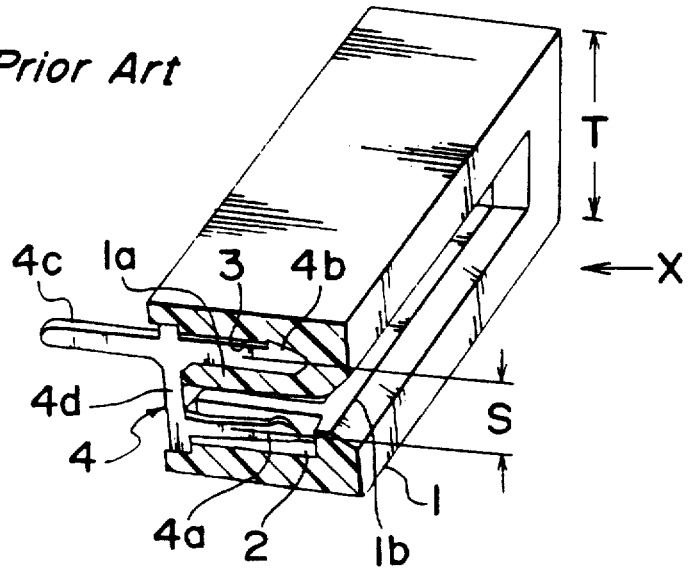
Fig. 9 Prior Art
FIG. 9 is a fragmentary-sectioned perspective view of the first prior art connector.
Figure 10:
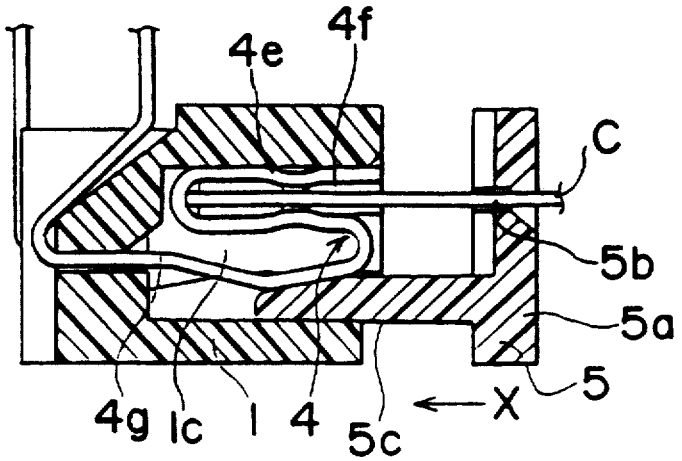
Fig. 10 Prior Art
FIGS. 10 and 11 are side sectional view of the second and third prior art connectors, respectively.
Figure 11:
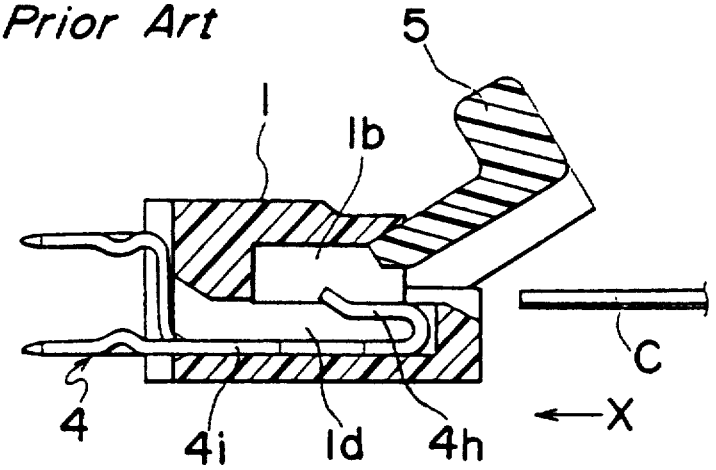
Fig. 11 Prior Art

As best shown in FIGS. 6 to 8, each of the side walls 13 and 14 of the housing 10 is formed with first and second detent projections 26 and 27 protruding outwardly from the associated side wall 13 or 14 into the retainer recess 24 or 25, said projections 26 and 27 being spaced a distance indicated by L1 in FIG. 7 in a direction conforming to the direction of insertion X. It is to be noted that the first detent projections 26 on the respective side walls 13 and 14 are positioned at a level above the level at which the second detent projections 27 on the respective side walls 13 and 14 are positioned.

On the other hand, as best shown in FIGS. 5 and 6, the arms 41 and 42 have generally elongated guide recesses 45 defined therein so as to open towards each other and also downwardly while leaving an engagement step at 45a and so as to extend in a direction conforming to the direction of insertion X, each of said guide recesses 45 being so shaped and so sized as to accommodate the first and second detent projections 26 and 27 therein. Specifically, each of the guide recesses 45 defined in the respective arms 41 and 42 is so sized and so shaped that, when the lock-on insert 40 is mounted onto the housing 10 with the arms 41 and 42 received in and guided along the associated retainer recesses 24 and 25, the arms 41 and 42 are forcibly expanded outwardly away from each other against their own resiliency to allow the first detent projections 26 to be received within the guide recesses 45 and are then allowed to resume the original shape as biased by their own resiliency.

Once the first detent projections 26 have been received within the associated guide recesses 45, free end faces 41a and 42a of the respective arms 41 and 42 are brought into engagement with the second detent projections 27, thereby holding the lock-on insert 40 at the temporarily inserted position. It is to be noted that the thickness, as indicated by L2 in FIG. 7, of a wall as measured from each of the end faces 41a and 41b to a leading end face defining the associated guide recess 45 with respect to the direction of insertion X is chosen to be smaller than the distance L1 between the first and second detent projections 26 and 27 so that, when the lock-on insert 40 is held at the temporarily inserted position in the manner described above, the lock-on insert 40 has a freedom of slight motion over a distance corresponding to the difference between the thickness L2 and the distance L1.

With the lock-on insert 40 held at the temporarily inserted position, not only can the lock-on insert 40 be retained on the housing 10, but also the sloped face 23b of the guide block 23 integral with the pent roof 11b lies parallel to and cooperates with the sloped side edge 44a of the wedge-like plate 44 integral with the elongated body 43 of the lock-on insert 40 thereby to define an insertion passage P through which the flat cable C can be inserted into the rectangular hollow 15 as best shown in FIG. 1.

A further push of the lock-on insert 40 results in the arms 41 and 42 to slide over the second detent projections 27 and then to assume the completely inserted position as shown in FIGS. 2 and 8. With the lock-on insert 40 held at the completely inserted position, the connector as a whole represents a generally rectangular cubic configuration with the connecting fingers 20 extending outwardly from the rear thereof for engagement with the socket (not shown) rigidly mounted on, for example, the printed circuit board.

In assembling, the terminal members 16 of identical shape are successively press-fitted into the corresponding passageways from rear in a direction counter to the direction of insertion X. At this time, each terminal member 16 is inserted with the contact and anchoring fingers 17 and 18 guided in the associated guide grooves 21 and 22 until the free end of the contact finger 17 is brought into abutment with the stop face 23a of the guide block 23. Once the free end of the contact finger 17 of the respective terminal member 16 is engaged to the stop face 23a as shown in FIGS. 1 and 2, the anchoring protuberance integral with the contact finger 17 is trapped in a respective recess defined in the top wall 11 in alignment with the associated guide groove 21, with the terminal member 16 consequently locked in position within the corresponding passageway.

Thereafter, the lock-on insert 40 is mounted to the housing 10 in the manner hereinbefore described until it assumes the temporarily mounted position, leaving the insertion passage P defined between the sloped face 23b and the sloped side edge 44a in the lock-on insert 40, thereby completing the connector according to the present invention. Insertion of the flat cable or flexible ribbon cable C to electrically connect the cable lines with the terminal members 16 is a job to be done by a user of the connector of the present invention.

To connect the cable lines of the flat cable C with the respective terminal members 16, the flat cable C is inserted generally slantwise into the rectangular hollow 15 through the insertion passage P shown in FIG. 1 while the lock-on insert 40 is held at the temporarily mounted position. The insertion passage P defined between the sloped face 23*b* and the sloped side edge 44*a* lying generally parallel to the sloped face 23*b* is chosen to be of a size sufficient to loosely accommodate the flat cable C, and this is possible because the lock-on insert 40 held at the temporarily mounted position has a freedom of play generally about a common axis extending between the first detent projections 26 then accommodated within the associated guide recesses 45 in the arms 41 and 42. Thus, it will readily be seen that the flat cable C can smoothly be guided into the rectangular hollow 15 until the front thereof is brought into engagement with stop walls 10*a* defined within the hollow 15 and on respective sides of each guide groove 22 as shown in FIG. 1.

After the insertion of the flat cable C into the rectangular hollow 15 in the housing 10, the lock-on insert 40 held at the temporarily mounted position has to be pushed to assume the completely mounted position as shown in FIG. 2 with the elongated body 43 held in contact with the side face 12*b* of the bottom wall 12. As the lock-on insert 40 is pushed in a direction conforming to the direction of insertion X by the application of an external pushing force thereto, wall portions of the respective arms 41 and 42, which define the corresponding thicknesses indicated by L2 in FIG. 7 slide over the associated second detent projections 27, with the arms 41 and 42 expanding outwardly away from each other against the resiliency of the lock-on insert 40, until projections 27 are received within the guide recesses 45 to allow the lock-on insert 40 to assume the completely mounted position as shown in FIG. 8.

During the movement of the lock-on insert 40 from the temporarily mounted position towards the completely mounted position, the front portion of the flat cable C situated within the rectangular hollow 15 is forced to displace upwardly, as viewed in FIGS. 1 and 2, by the wedge-like plate 44 then moving underneath the front portion of the flat cable C, and the cable lines at the front portion of the flat cable C are finally engaged with the adjacent contact protuberances 17*a* of the terminal members 16. At the same time, the lock-on insert 40 is locked in the completely mounted position.

Although the present invention has been described in connection with the preferred embodiment thereof with reference to the accompanying drawings, it is to be noted that various changes and modifications are apparent to those skilled in the art. For example, the connecting fingers 20 extending outwardly from the connector, although having been described as received in the external socket mounted on the printed circuit board, may be soldered directly with circuits on the printed circuit board, a flexible printed circuit board, or a flexible wired circuit.

Such changes and modifications are to be understood as included within the scope of the present invention as defined by the appended claims, unless they depart therefrom.

What is claimed is:

1. A connector for a flat cable having a plurality of cable lines laid in a common plane in a side-by-side fashion with each other, said connector comprising:

a housing having a longitudinal axis and also having a hollow defined therein, said hollow opening outwardly at a front face of said housing, said housing first and second walls opposite to each other, and a rear wall;

said first wall of the housing having a plurality of first guide grooves defined therein in communication with the hollow, and a sloped face;

said second wall of the housing having second guide grooves equal in number to the number of the first guide grooves and defined therein in communication with the hollow and immediately beneath associated first guide grooves;

terminal members of generally h-shaped configuration equal in number to the number of each of the first and second guide grooves and arranged in side-by-side fashion in a direction parallel to the longitudinal axis of the housing, each of said terminal members including a contact finger having a contact protuberance formed integrally therewith, an anchoring finger extending generally parallel to the contact finger and connected at one end with one end of the contact finger remote from the contact protuberance, and a connecting finger;

each of said terminal members being accommodated within the housing with the contact and anchoring fingers firmly received within the respective first and second guide grooves while the contact protuberance protrudes into the hollow, said connecting finger of each terminal member extending outwardly from the rear wall of the housing when the respective terminal member is accommodated within the housing;

a lock-on insert means adapted to be fully inserted into the hollow to allow the cable lines to be held in contact with the associated contact protuberances, said lock-on insert means being inserted into the hollow after the flat cable has been inserted into the hollow; and means for holding the lock-on insert means at a temporarily mounted position to facilitate easy insertion of the flat cable into the hollow, and wherein said lock-on insert means includes a generally wedge-like plate member adapted to be engaged into the hollow, said wedge-like plate member having a sloped side edge which defines an insertion passage of an increased size in cooperation with said sloped face of the first wall when the lock-on insert means is held at the temporarily mounted position, and wherein the size of said insertion passage is decreased when said lock-on insert means has been fully inserted into the hollow.

2. The connector as claimed in claim 1, wherein said lock-on insert means also includes a pair of arms lying generally perpendicular to the wedge-like plate member, each of said arms having a guide recess defined therein and extending in a direction conforming to the direction of insertion of the flat cable into the hollow, and wherein said housing has a pair of side guide grooves for receiving the arms with the wedge-like plate member inserted into the hollow, and wherein said holding means comprises a pair of first detent projections protruding laterally outwardly from opposite side walls of the housing, said guide recesses in said arms receiving therein the first detent projection thereby to prevent the lock-on insert means from being separated from the housing.

* * * * *

UNITED STATES PATENT AND TRADEMARK OFFICE

CERTIFICATE OF CORRECTION

PATENT NO. : 5,308,262
DATED : May 3, 1994
INVENTOR(S) : Masamitsu CHISHIMA

It is certified that error appears in the above-indentified patent and that said Letters Patent is hereby corrected as shown below:

At column 10, line 1 (claim 1, line 6), change "housing, said housing" to ---housing, said housing including---.

Signed and Sealed this

Fourteenth Day of March, 1995

*Attest:*

*Attesting Officer*

BRUCE LEHMAN

*Commissioner of Patents and Trademarks*